US007040947B2

(12) United States Patent
Ashida et al.

(10) Patent No.: US 7,040,947 B2
(45) Date of Patent: May 9, 2006

(54) METHOD OF FORMING ELECTRODE LAYERS

(75) Inventors: Hideki Ashida, Suita (JP); Junichi Hibino, Neyagawa (JP); Keisuke Sumida, Hirakata (JP); Mitsuhiro Ohtani, Sakai (JP); Shinya Fujiwara, Kyoto (JP); Hideki Marunaka, Suita (JP); Tadashi Nakagawa, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 12 days.

(21) Appl. No.: 11/092,075

(22) Filed: Mar. 29, 2005

(65) Prior Publication Data

US 2005/0181697 A1 Aug. 18, 2005

Related U.S. Application Data

(62) Division of application No. 10/362,807, filed as application No. PCT/JP01/07391 on Aug. 28, 2001, now Pat. No. 6,891,331.

(30) Foreign Application Priority Data

Aug. 30, 2000 (JP) ..... 2000-260420

(51) Int. Cl.
*H01J 9/00* (2006.01)

(52) U.S. Cl. ..... 445/24

(58) Field of Classification Search ..... 445/23–25
See application file for complete search history.

(56) References Cited

U.S. PATENT DOCUMENTS 6,555,594 B1 4/2003 Fukushima et al.

FOREIGN PATENT DOCUMENTS

| | | |
|---|---|---|
| JP | 09-283032 | 10/1997 |
| JP | 10-334810 | 12/1998 |
| JP | 11-007897 | 1/1999 |
| JP | 11-120906 | 4/1999 |
| JP | 11-283511 | 10/1999 |
| JP | 2000-173475 | 6/2000 |
| JP | 2000-221671 | 8/2003 |
| WO | 00/45224 | 8/2000 |

*Primary Examiner*—Joseph Williams

(57) ABSTRACT

A method of manufacturing at least two layer electrodes that can be utilized, for example, as bus and data electrodes in a plasma display device, includes depositing each layer in a coating step and subsequently exposing the layers at the same time for development. The layers are subsequently baked at the same time. One layer can be thinner than the other layer during a time period between the developing step and the baking step.

12 Claims, 12 Drawing Sheets

METHOD OF FORMING ELECTRODE LAYERS

RELATED APPLICATIONS

The present application is a divisional application of Ser. No. 10/362,807 filed on Jul. 21, 2003 now U.S. Pat. No. 6,891,331, which is a 371 of PCT/JP01/07391, filed Aug. 28, 2001.

TECHNICAL FIELD

The present invention relates to plasma display devices and methods for manufacturing the same. More specifically, it relates to methods for forming electrodes that greatly contribute to improve reliability of the plasma display devices.

BACKGROUND ART

An example of conventional plasma display panels (hereinafter referred to as PDPs) is shown in FIG. 12, a perspective sectional view of a part of a conventional AC PDP.

As shown in FIG. 12, the AC PDP comprises a front substrate 305 and a back substrate 315. The front substrate 305 is such that a plurality of pairs of line-shaped scanning electrodes 301 and sustaining electrodes 302 are disposed in parallel on a transparent first glass substrate 300 (insulating substrate), and a dielectric layer 303 and a protective layer 304 are laminated over the electrodes. The back substrate 315 is such that a plurality of line-shaped data electrodes 311, positioned perpendicular to the scanning electrodes 301 and the sustaining electrodes 302, are disposed on a second glass substrate 310 (insulating substrate), a dielectric layer 312 is disposed over the data electrodes 311, barrier ribs 313 are disposed on the dielectric layer 312 in parallel lines so as to sandwich the data electrodes 311 therebetween, and phosphor layers 314 each having each color are mounted between the barrier ribs 313 along side walls thereof.

In a gap between the front substrate 305 and the back substrate 315, a rare gas, which is at least one of helium, neon, argon, krypton, and xenon, is enclosed as discharge gas, so as to form light emitting cells (or discharging spaces) 320 at open spaces where the scanning electrodes 301 and the sustaining electrodes 302 and the data electrodes 311 intersect each other in the gap in which the gas is enclosed.

The scanning electrodes 301 and the sustaining electrodes 302 each are made of line-shaped conductive transparent electrodes 301*a* and 302*a* respectively in addition to bus electrodes 301*b* and 302*b* formed thereon respectively. The bus electrodes 301*b* and 302*b* contain silver (Ag), and are line-shaped and thinner than the transparent electrodes 301*a* and 302*a*. The data electrodes 311 also contain Ag.

The AC PDP is operated as follows. During a drive sustaining period after an initialization period and an address period, a pulse voltage is applied to the scanning electrodes 301 and the sustaining electrodes alternately. Then a sustaining discharge is caused in the discharging space 320 by the electric field generated between two parts on a surface of the protective layer 304 above the scanning electrodes 301 and above the sustaining electrodes 302, with the dielectric layer 303 interposed between the electrodes and the protective layer 304. Ultra-violet ray emitted by the sustained discharge excites phosphors in the phosphor layers 314, and visible light from the phosphor layers 314 is used for display light.

Here, a process for forming the scanning electrodes 301, the sustaining electrodes 302, the dielectric layer 303 and the protective layer 304 formed on the first glass substrate is briefly explained. First, the line-shaped conductive transparent electrodes 301*a* and 302*a* made of tin oxide or indium tin oxide (ITO) are formed on the first glass substrate 300. By patterning and baking a photosensitive paste containing Ag over the transparent electrodes using photolithography, the line-shaped bus electrodes 301*b* and 302*b* containing Ag are formed. Further, the dielectric layer 303 is formed by printing and baking a dielectric glass paste. Finally, the protective layer 304 is formed by evaporating magnesium oxide (MgO).

Next, a method for forming the data electrodes 311, the dielectric layer 312, the barrier ribs 313 and the phosphor layers 314 formed on the second glass substrate is briefly explained. First, by performing a photolithography method to the photosensitive paste containing Ag and baking the same, the line-shaped data electrodes 311 containing Ag are formed on the second glass substrate.

Then, by printing and baking a dielectric glass paste over the data electrodes 311, the dielectric layer 312 is formed. Further, the barrier ribs 313 are formed using a screen printing method, a photolithography method, and the like, and after that, the phosphor layers 314 are formed using such a method like a screen printing method and an ink-jet method.

Finally, the front substrate 305 and the back substrate 315, each obtained in the above stated process, are attached together (sealing) in a manner that a sealing glass interposed therebetween at the circumference of the substrates are molten and cooled down, and then exhausting air and enclosing a rare gas are done, and thus the panel is formed.

Next, a more specific explanation about the method for forming the bus electrodes 301*b* and 302*b* and the data electrodes 311 by the photolithography method using the Ag photosensitive paste is given below.

First, by applying the Ag photosensitive paste uniformly using the printing and the like method, an Ag photosensitive paste layer is formed on the first glass substrate 300 to which ITO is evaporated. Then, dry treatment is performed so as to remove a solution from the Ag photosensitive paste layer.

Next, by irradiating ultra-violet ray through a photomask, an exposed part and un-exposed part are formed on the Ag photosensitive paste layer corresponding to an electrode patterns. The exposed part later forms a pattern for the bus electrodes.

Further, the exposed part is fixed on the first glass substrate 300 by performing a developing treatment.

Finally, by performing baking treatment, pre-baked electrodes are made into the bus electrodes.

As have been explained in the above, in a case where the patterning is carried out using the photolithography method to the Ag photosensitive paste, the baking treatment is always performed after the patterning in order to burn the resin component in the paste, and it has been noted as a problem that an edge-curl is caused in this process. The edge-curl is considered to be caused mainly by an effect of tensile force during heating.

The edge-curl is a phenomenon in which the side edges of the pre-baked bus electrodes camber upward of the first glass substrate after baking. When the edge-curl occurs, it becomes difficult to form the dielectric layer over the bus electrodes. In addition, a surface angle of side edges after baking could become very sharp. Because an electric field concentrates at the sharp edges in driving the panel, the dielectric layer formed so as to cover the electrodes becomes susceptible to dielectric breakdown. For this reason, a surface of the side edges of the bus electrodes and the data electrodes are polished after baking in some cases, so as to make the side edges obtuse.

It has also been noted as a problem that, because light reflectivity of silver material is relatively large, contrast in the display light emission is drastically deteriorated when the bus electrodes on the front substrate are made of material containing Ag as explained above due to incident light to a surface of the front substrate reflected by the bus electrodes. For this reason, the bus electrodes having an optical bilayer structure, a composite lamination in which two metal layers each containing black pigment and silver respectively are laminated in a stated order on the first glass substrates (hereinafter referred to as a "black and white composite lamination"), is put into practical use as the bus electrodes disposed on the front substrate.

Such bus electrodes having the bilayer structure are also formed using the photolithography method as in the case of the electrodes having one layer as explained above.

More specifically, a first printed layer is formed by applying a photosensitive paste containing black pigment Next, the paste is dried so as to remove a solution from the first printed layer.

Then, a second printed layer is formed by applying an Ag photosensitive paste on the first printed layer. Further, the first and second printed layers are dried so as to remove solutions from the both layers.

Next, by irradiating ultra-violet ray through a photomask, an exposed part and an unexposed part corresponding to an electrode pattern are formed on the first and second printed layers. Usually, the exposed part later forms a pattern for a black and white composite lamination.

After this, the exposed part is fixed to the first glass substrate by developing.

Then, by baking, the laminated layers of black pigment and Ag become the black and white composite lamination.

In the forming process, the side edges of the black and white composite lamination could also camber upward (edge-curl). Accordingly, a sectional surface of the black and white composite lamination in a widthwise direction becomes concave, and the side edges sharp surface angles in some cases.

DISCLOSURE OF THE INVENTION

The present invention is made in view of the above problems. An object of the present invention is to provide methods for manufacturing electrodes, in which edge-curl is effectively suppressed when patterning metal electrodes such as bus electrodes and data electrodes for a plasma display device is mainly performed using the photolithography method. Another object of the present invention is to provide plasma display devices having electrodes that are substantially free from the edge-curl.

A plasma display device of the present invention is a plasma display device having a plurality of electrodes formed on a substrate by a layer of material being patterned mainly by a photolithography method and then baked, the material of the electrodes containing glass, wherein side edges of at least one of the plurality of electrodes are rounded edges, and surfaces of the rounded edges have a curvature that changes continuously.

The side edges (surfaces of the electrodes at boundaries between a dielectric layer) of such a plasma display panel are not sharp unlike a case in which edge-curl occurs, and accordingly an electric field does not concentrate locally. Especially, in comparison with a case in which a surface angle of the side edges is sharp, the degree of concentration of electric field is remarkably reduced. Therefore, it is possible to achieve a plasma display device having a high reliability with an excellent pressure resistance when the dielectric layer covers the side edges. Note that although glass in the material of the electrodes also becomes soft in baking in the conventional method, it does not form rounded edge as in the present invention.

In addition, in a case where electrodes are formed by a screen printing method in which the bus electrodes and the data electrodes are patterned by the and then baked, edge-curl does not occur too much in comparison with a photolithography method, because an amount of resin component in a paste for the screen printing and shrinkage percentage in baking are relatively small and therefore stress to camber upward is small. However, in the screen printing, linearity of the electrodes in a lengthwise direction decreases, because the paste flows due to steps such as leveling. Accordingly, when the electrodes are patterned by the screen printing method, a problem that the linearity of the line-shaped electrodes decreases occurs while edge-curl can be suppressed. According to the present invention as stated above, the linearity of the electrodes is maintained because the patterning is performed by exposure, and the surfaces of the side edges becomes rounded.

It is also possible that each of the plurality of electrodes is a multi-layer lamination made up of at least a first layer and a second layer, the first layer being formed on the substrate, and the second layer being formed on the first layer.

It is also possible that the curvature of the surfaces of the rounded edges is such that a radius of the curvature is quarter to ten times as large as an average thickness of the electrodes after baking.

It is also possible that the first layer is thicker in a vicinity of the side edges than in a vicinity of a central part.

It is also possible that the first layer is thicker in a vicinity of a central part than in a vicinity of the side edges.

It is also possible that the first layer and the second layer have different optical characteristics.

It is also possible that the first layer is made of black material.

A method for manufacturing a plasma display device of the present invention is a method for manufacturing a plasma display device having an electrode formation process in which a plurality of electrodes are formed on a substrate in a manner that a layer of material is patterned mainly by a photolithography method and then baked, the material of the electrodes containing glass, wherein the electrode formation process comprises: a developing step for developing the layer to a degree where an amount of undercut becomes half to three times as large as a thickness of the electrodes after development; and a baking step for heating up the glass material contained in the protrusion formed by the amount of the undercut in the developing step to a degree where the glass material becomes soft so as to touch the substrate.

Further, a method for manufacturing a plasma display device of the present invention is a method for manufacturing a plasma display device having an electrode formation process in which a plurality of electrodes are formed on a substrate in a manner that a layer of material is patterned mainly by a photolithography method and then baked, wherein, in the electrode formation process, the electrodes having at least two layers are formed by a photolithography method using a paste containing photosensitive material, conductive material, and glass material, the electrode formation process comprising: at least two coating steps; a simultaneous exposing step in which the layers are exposed at the same time; a simultaneous developing step in which the layers are developed at the same time; and a simultaneous baking step in which the layers are baked at the same time, and wherein, in the simultaneous developing step, the paste is developed to an extent where an amount of undercut becomes half to three times as large as a thickness of the electrodes after development; and in the simultaneous baking step, the paste is heated up to an extent where the glass material in the paste becomes soft so as to touch the substrate.

Further, a method for manufacturing a plasma display device of the present invention is a method for manufacturing a plasma display device having an electrode formation process in which a plurality of electrodes are formed on a substrate in a manner that a layer of material is patterned mainly by a photolithography method and then baked, wherein, in the electrode formation process, the electrodes having at least two layers are formed by a photolithography method using a paste containing photosensitive material, conductive material, and glass material, the two layers being a first layer and a second layer laminated in a stated order on the substrate, the electrode formation process comprising: at least two coating steps; at least two exposing steps; a simultaneous developing step in which the layers are developed at the same time; and a simultaneous baking step in which the layers are baked at the same time, and wherein, in the at least two exposing steps, a width of an exposed part of a layer to be the first layer is made smaller than a width of an exposed part of another layer to be the second layer, and in the simultaneous baking step, the paste is heated up to an extent where the glass material in the paste becomes soft so as to touch the substrate.

According to the conventional method, although the glass material becomes soft in baking, it does not become soft enough to touch the substrate by gravity, and therefore the stress is not resolved. According to the method of the present invention, however, baking is performed at a temperature such that the glass in the paste becomes soft so as to touch the substrate by gravity, and therefore the upward stress to cause edge-curl and camber the electrodes is resolved. In addition, the side edges becomes rounded by melted in baking, and the concentration of electric field is reduced in comparison with a case in which side edges are not round. Especially, the difference is remarkable when compared with a case in which the surface angle is sharp. As a result, the reliability of the panel improves, such as improvement in the isolation voltage.

It is also possible that the plurality of electrodes are fence electrodes having a short-bar pattern on the second layer.

It is also possible that the first layer is thinner than the second layer during a time between developing and baking.

It is also possible that, in the coating step, the first layer is formed on the substrate so that a thickness of the first layer in a vicinity of a central part becomes larger or smaller than a thickness of the first layer in a vicinity of the both side edges, and the conductive material is patterned on the substrate including the first layer by using a photolithography method. Such a step is effective to obtain a surface angle rounded in a widthwise direction.

It is also possible that, in one of the simultaneous baking step and the baking step, the glass material is baked at a temperature higher than a softening point of the glass material by 30° C. to 100° C.

BEST MODE FOR CARRYING OUT THE INVENTION

First Embodiment

[Construction of Panel]

Figure 1:
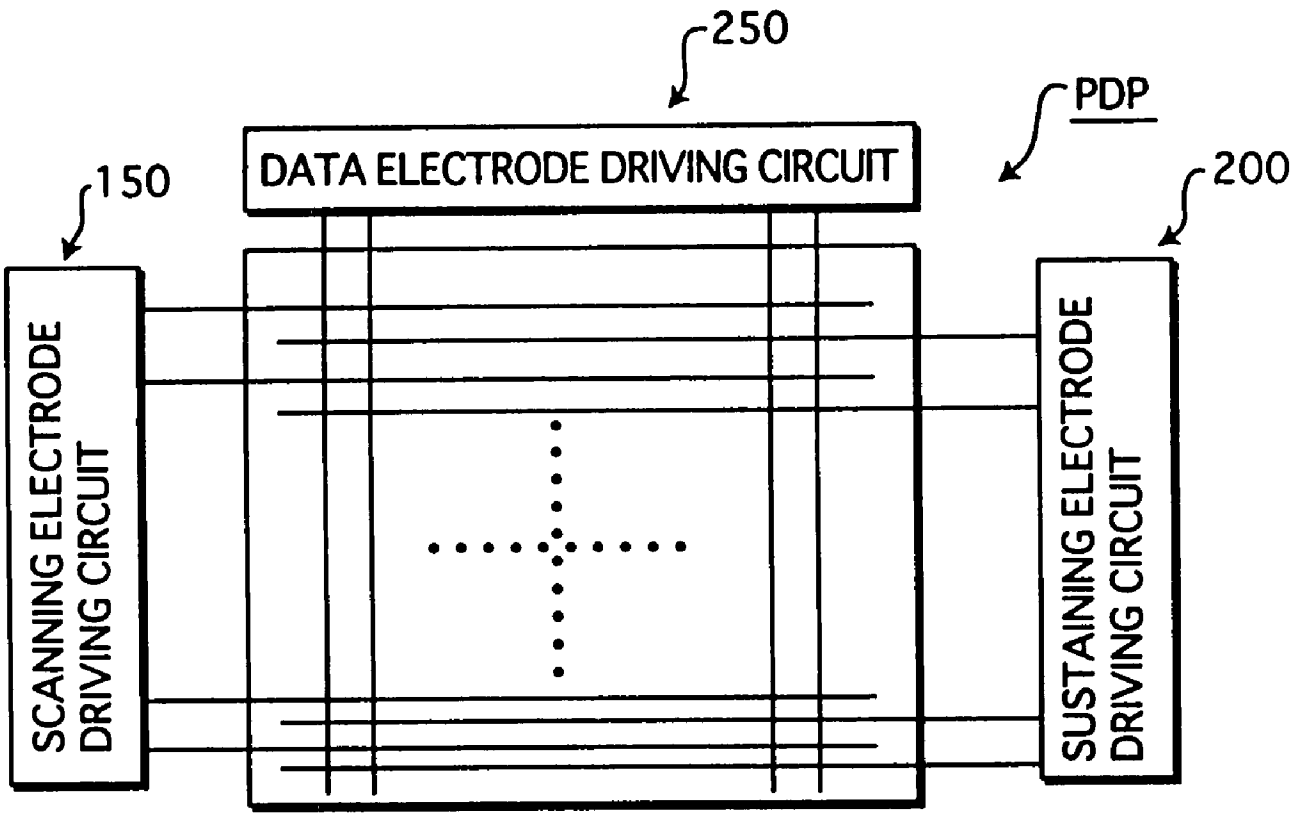
FIG. 1 is a block diagram illustrating a construction of a plasma display device according to each embodiment of the present invention.

FIG. 1 is a block diagram illustrating a construction of an AC plasma display device according to the First Embodiment of the present invention.

As shown in this figure, an AC plasma display device comprises a plasma display panel and driving circuits 150, 200, and 250.

Figure 2:
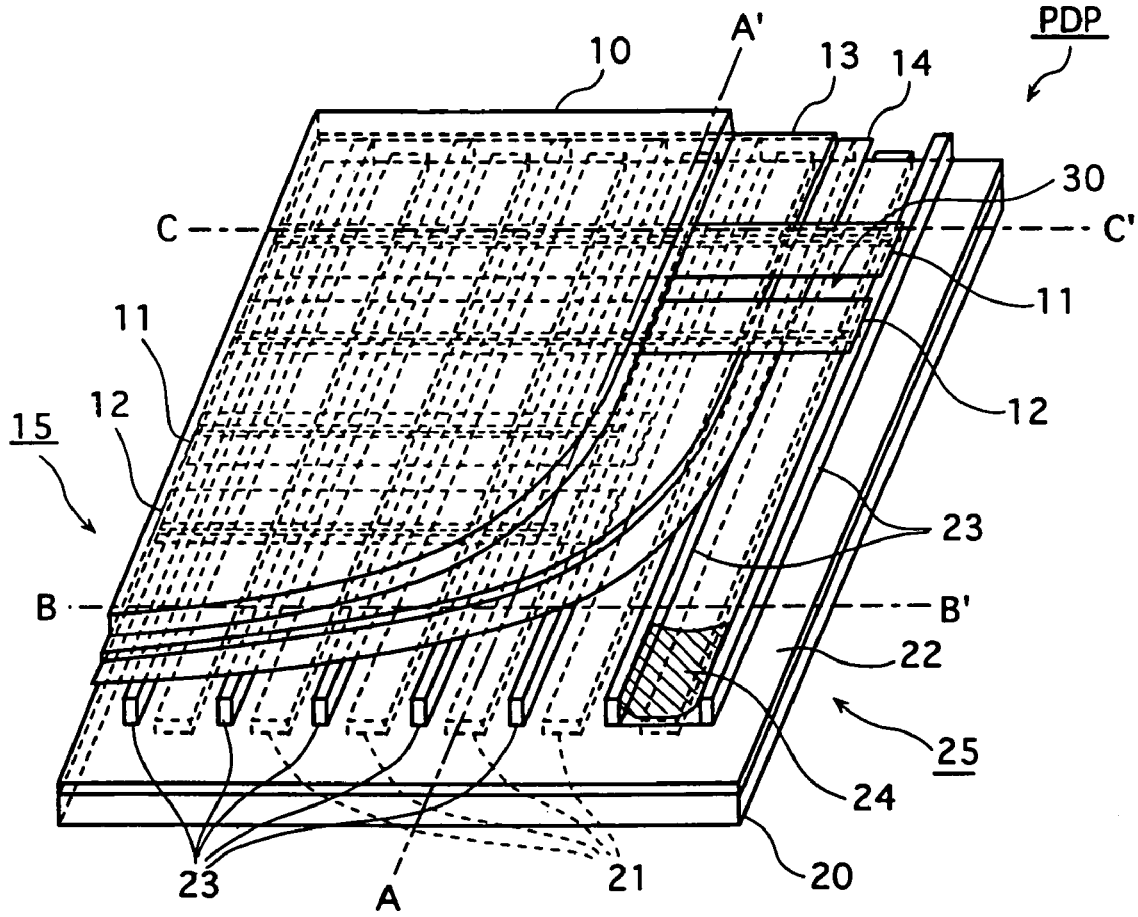
FIG. 2 is a perspective view illustrating a construction of a PDP.

FIG. 2 is a perspective view illustrating a main construction of a PDP. As shown in this figure, the PDP comprises a front substrate 15 and a back substrate 25. The front substrate 15 is such that a plurality of pairs of line-shaped scanning electrodes 11 and sustaining electrodes 12 are disposed in parallel on a transparent first glass substrate 10, and a dielectric layer 13 and a protective layer 14 are laminated over the electrodes. The back substrate 25 is such that a plurality of line-shaped data electrodes 21, positioned perpendicular to the scanning electrodes 11 and the sustaining electrodes 12, are disposed on a second glass substrate 20, a dielectric layer 22 is disposed over the data electrodes 21, barrier ribs 23 are disposed on the dielectric layer 22 in parallel lines so as to sandwich the data electrodes 21 therebetween, and phosphor layers 24 each having each color are mounted between the barrier ribs 23 along the side walls thereof.

In a gap between the front substrate 15 and the back substrate 25, a rare gas, which is at least one of helium, neon, argon, krypton, and xenon, is enclosed as discharge gas, so as to form light emitting cells 30 at open spaces where the scanning electrodes 11 and the sustaining electrodes 12 and the data electrodes 21 intersect each other in the gap in which the gas is enclosed.

The driving circuits that are connected to the PDP includes a scanning electrode driving circuit 150, a sustaining electrode driving circuit 200, and a data electrode driving circuit 250, and each driving circuit takes each part in driving operation.

In other words, the PDP is usually driven by each of the driving circuits in a so called "intra-field time divisional gray-scale displaying method", in which it is possible to display desired middle scale by dividing one field period into a plurality of sub-field periods. In this method, a desired scale value is displayed by repeating a series of operations: generating image data for sub-field based on input image signals, taking the data as write-in data and writing the data by sub-field, and then, performing sustaining discharge.

Figure 3:
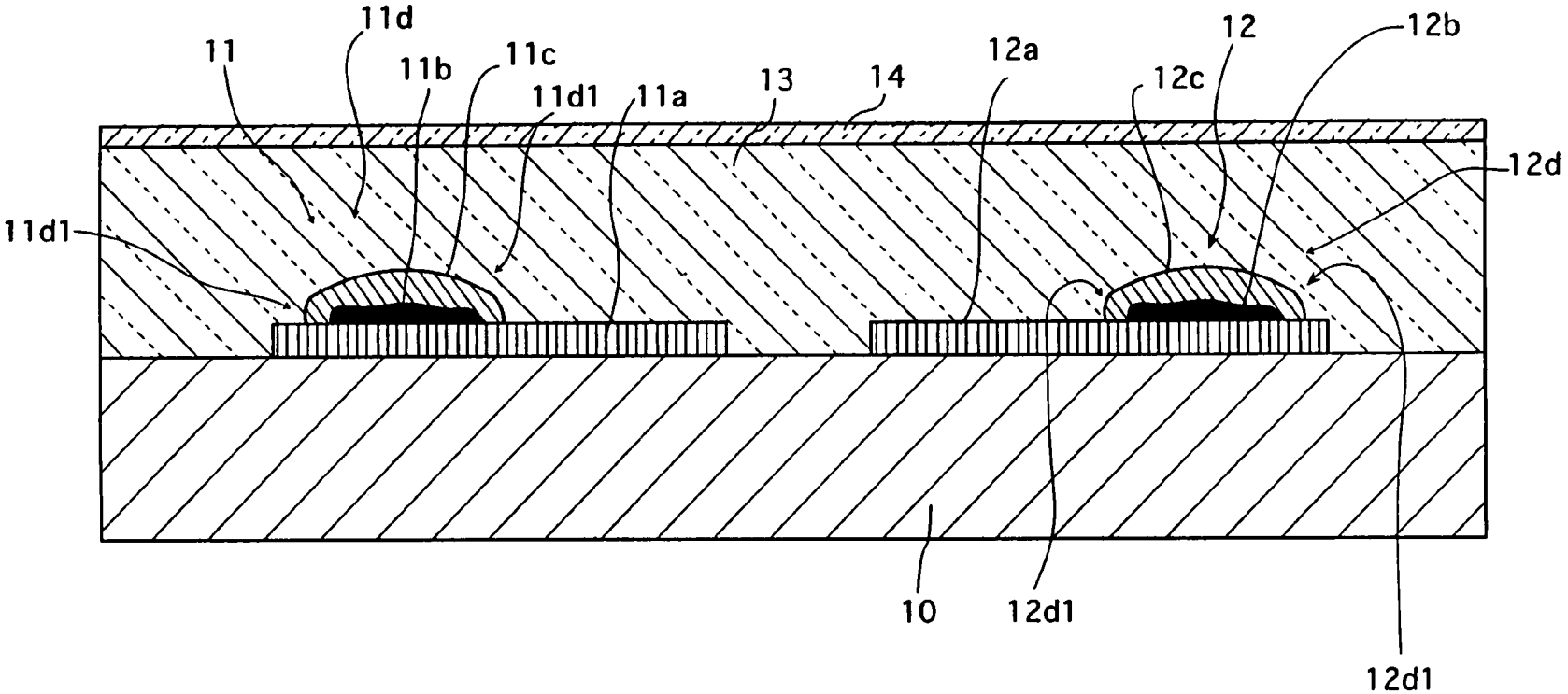
FIG. 3 is a cross-sectional view illustrating a detailed construction of scanning electrodes and sustaining electrodes.

FIG. 3 is a vertical cross-sectional view taken at line A–A' in FIG. 2, illustrating cross-sectional shapes of the scanning electrodes and the sustaining electrodes in a widthwise direction.

The scanning electrodes 11 and the sustaining electrodes 12 each are made of (i) line-shaped conductive transparent electrodes 11*a* and 12*a* respectively, (ii) black and line-shaped first conductive layers 11*b* and 12*b* that are formed on and thinner than the conductive transparent electrodes 11*a* and 12*a* respectively, and (iii) low-resistant second conductive layers 11*c* and 12*c* further formed on the first conductive layers 11*b* and 12*b* respectively. In terms with a function that the metal electrodes absorb outer light (in other words, from optical view point), employing a black and white composite lamination having the optical bilayer structure is the same as in the conventional PDP. A structure of electrodes made of the first conductive layer 11*b* and the second conductive layer 11*c* as stated above is called a bus electrode 11*d*. Similarly, a structure of electrodes made of the first conductive layer 12*c* and the second conductive layer 12*c* is called a bus electrode 11*d* and a bus electrode 12*d*.

In addition, in the bus electrodes 11*d* and 12*d*, the first conductive layers 11*b* and 12*b* are each covered by the second conductive layers 11*c* and 12*c* respectively. Accordingly, side edges 11*d*1 and 12*d*1 becomes rounded whose curvature changes continuously in a widthwise direction. The curvature of the rounded edge defined by a radius of the curvature is such that the radius of the curvature is quarter to ten times, preferably half to five times, as large as an average thickness of the electrodes after baking. In addition, an average radius of the curvature of the side edges becomes no larger than quarter of the thickness of the electrodes after baking, and therefore no protrusion is formed. Such a shape can improve isolation voltage of the dielectric layer that covers the scanning electrodes 11 and the sustaining electrodes 12. The reason of this is because the side edges 11*d*1 and 12*d*1 are rounded and the curvature of the side edges changes smoothly in a widthwise direction, the degree in which an electric field concentrates locally is reduced in comparison with a case in which the side edges 11*d*1 and 12*d*1 are sharp. The difference becomes even more remarkable, especially when compared the conventional art with a case in which the average radius of the curvature of the side edges is no larger than quarter of the thickness of the electrodes after baking and the surface angle becomes acute at the side edges.

Figure 4:
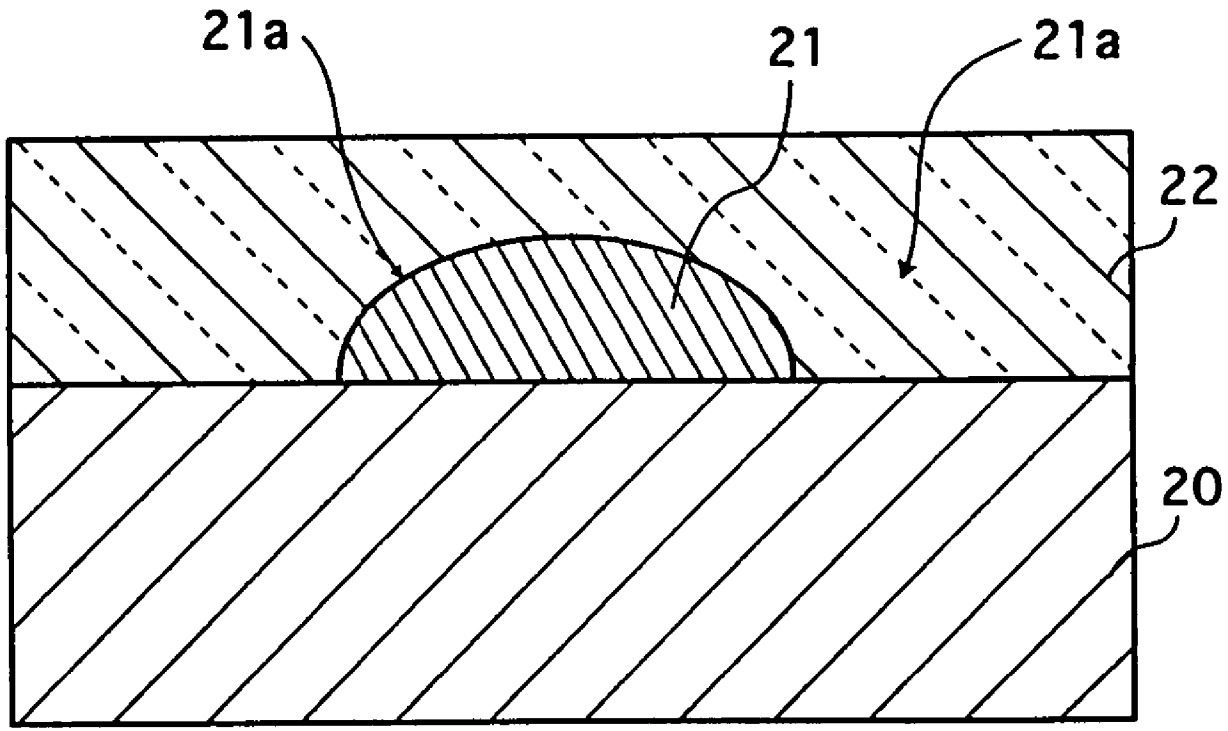
FIG. 4 is a cross-sectional view illustrating a detailed construction of data electrodes.

FIG. 4 is a part of cross-sectional view taken at line B–B' in FIG. 2, illustrating a vertical cross-sectional shapes of the data electrodes in a widthwise direction.

As shown in this figure, while the data electrode 21 is different from the bus electrode and is made of a single layer, the cross-sectional shape in a widthwise direction has such a characteristic that a side edge 21*a* of the data electrode is rounded whose curvature changes continuously in a widthwise direction.

[Manufacturing Method]

Next, an explanation about a manufacturing method of the panel described above is given below.

First, the scanning electrodes 11 and the sustaining electrodes 12 are formed on the first glass substrate 10, the dielectric layer 13 made of dielectric glass is formed so as to cover the scanning electrodes 11 and the sustaining electrodes 12, and then the protective layer 14 made of MgO is formed on the dielectric layer 13. Next, the data electrodes are formed on the second glass substrate, and then the dielectric layer 22 made of dielectric glass is formed thereon, and further the barrier ribs 23 made of glass are formed in a predetermined interval.

In each space sandwiched between the barrier ribs, phosphor layers 24 having each color are formed by disposing phosphor pastes containing red, green, or blue phosphor respectively, and then the phosphor layers are baked at a temperature about 500° C. so as to remove resin component in the paste. (Phosphor Baking Step).

After baking the phosphor, glass frit for sealing the first and the second glass substrates is applied to the circumference of the first glass substrate, and then temporary baked at a temperature around 350° C. so as to remove resin composition in the glass frit. (Sealing Glass Temporary Baking Step).

Then, the front and back substrates formed as described above are put together such that the scanning electrodes and sustaining electrodes on the front substrate and the data electrodes on the back substrate are positioned perpendicularly, then sealed around the substrate with the sealing glass by baking at a temperature around 450° C. (Sealing Step).

Further, air in the panel is exhausted while heated at a predetermined temperature (around 350° C.) (Exhausting Step) and a discharge gas is filled therein at a predetermined pressure.

After the panel is formed as have been described above, a plasma display device is manufactured by connecting each driving circuit to the panel.

[Electrodes Formation Method]

[Scanning and Sustaining Electrodes]

[Formation Method 1]

FIGS. 5A–5F are process drawings illustrating a formation method of the scanning electrodes 11 and the sustaining electrodes 12 according to the present Embodiment.

Figure 5A:
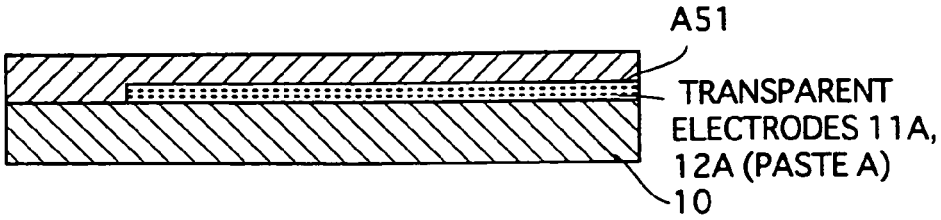
FIGS. 5A–5F are process drawings illustrating a formation method of the scanning electrodes and the sustaining electrodes.

First, a black negative photosensitive paste A containing $RuO_2$ particles and such is applied so as to cover the transparent electrodes using a screen printing method. The negative photosensitive paste A is then dried in an IR furnace having a temperature profile such that the temperature goes up linearly from the room temperature to 90° C. and keeps the temperature at 90° C. for a certain period of time, for example. A photosensitive metal electrode layer A51, which is the negative photosensitive paste A from which a solution and such are removed, is thus obtained (FIG. 5A).

Figure 5B:
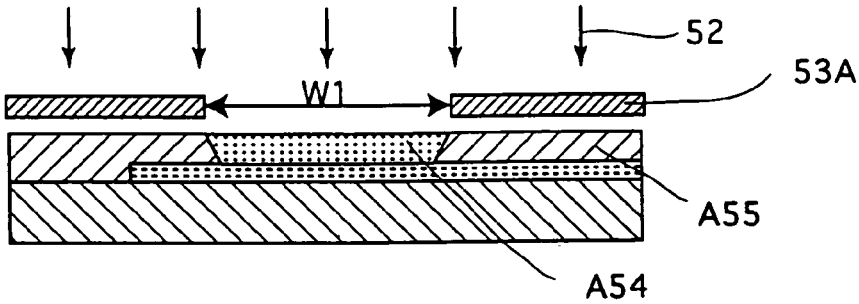

Next, the photosensitive metal electrode layer A51 is exposed by ultraviolet ray 52 irradiated through an exposure mask 53A having a first line width 1 (30 μm for example). In exposure, a crosslinking reaction proceeds from a top surface of the photosensitive metal electrode layer A51 so as to high-polymerize the layer. An exposed part A54 and a non-exposed part A55 are thus formed (FIG. 5B).

Note that, because the crosslinking reaction starts from the top surface of the layer, the reaction does not reach a bottom surface of the layer when the exposure conditions are set as follows: the luminance is 10 $mW/cm^2$, the light exposure is 200 $mJ/cm^2$, and the distance between the mask and the substrate (hereinafter referred to as proxy amount) is 100 μm.

Figure 5C:
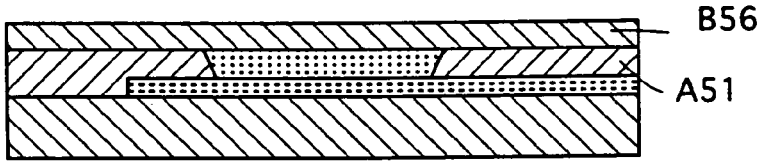

Next, a negative photosensitive paste B containing Ag particles is applied to the exposed photosensitive metal electrode layer A51 by a screen printing method. By drying the paste so as to remove a solution and such from the negative photosensitive paste B in the IR furnace having the same temperature profile as stated above, a photosensitive metal electrode layer B56 is formed (FIG. 5C).

Figure 5D:
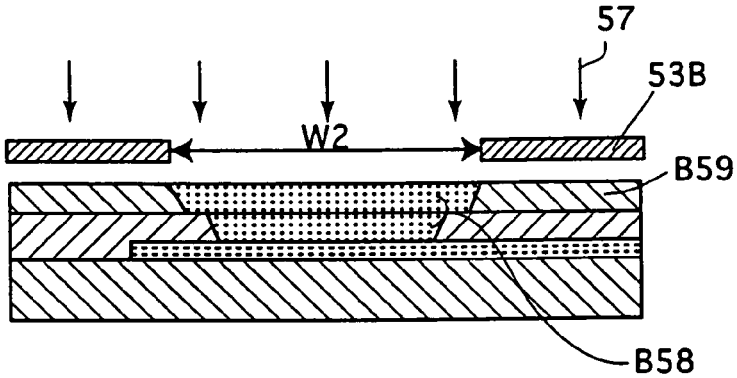

Further, the photosensitive metal electrode layer B56 is exposed by an ultraviolet ray 57 irradiated under the same conditions as stated above through an exposure mask 53B having a second line width W2 (40 μm for example) wider than the first line width W1. In exposure, a crosslinking reaction from a top surface of the photosensitive metal electrode layer B56, and thus an exposed part B58 and a non-exposed part B59 are formed (FIG. 5D). Note that the crosslinking reaction also does not reach the bottom surface of the layer.

Figure 5E:
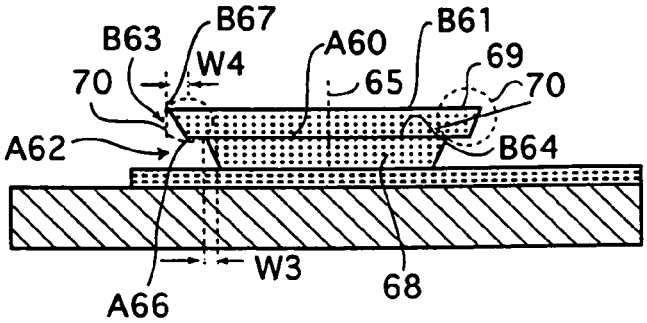

Next, development is performed using a developing solution. As the developing solution, an aqueous solution containing 0.4 wt % of sodium carbonate is commonly used. As shown in FIG. 5E, the non-exposed parts A55 and B59 are removed and the patterned photosensitive metal electrode layers A51 and B56 remain. The amount of elution of component to form the layers caused by development are small at top surfaces A60 and B61 of the exposed part A54 of the photosensitive metal electrode layer A51 and the exposed part B58 of the photosensitive metal electrode layer B56 respectively, while the amount of elution of component at bottom surfaces are large because the crosslinking reaction does not reach the bottom surfaces of the layers.

At the top surfaces A60 and B61 of the exposed parts A54 and B58, dissolution by the developing solution does not proceed greatly, because the crosslinking reaction proceeds sufficiently as have been explained above in comparison with the bottom surfaces, while dissolution by the developing solution proceeds greatly at the bottom surfaces of the layers. Accordingly, undercuts A62 and B63 are formed at the exposed parts A54 and B58 respectively. However, the top surface of the exposed part A54, where the crosslinking reaction proceeds sufficiently, is in touch with the bottom surface B64 of the exposed part B58, and thus penetration depth of dissolution (such a phenomenon in which a dissolution area penetrates toward the center of a electrode is called undercut, and the degree of penetration is called the amount of undercut. Specifically, it is defined as the penetration depth of dissolution W3 and W4 from edge parts A66 and B67 of the top surface of each exposed part toward a central part 65 of the layer) toward a central part 65 pf the exposed part is restricted by the top surface A60 of the exposed part A64.

Consequently, as shown in FIG. 5E, a cross-section of the exposure part A54 forms a trapezoidal part 68 with an upper base being as long as the top surface of the layer at the exposure part A54 in a widthwise direction, and across-section of the exposure part B58 forms a trapezoidal part 69 with an upper base being as long as the top surface of the layer at the exposure part B58 in a widthwise direction, and a lower base being as long as the top surface of the exposure part A54 in a widthwise direction.

In addition, because the upper base of the trapezoidal part 69 is longer than the upper base of the trapezoidal part 68, a part of the trapezoidal part 69 projects from the trapezoidal part 68 when viewed at a cross-section taken in a widthwise direction. Such a projecting part is called a protrusion 70.

Next, a simultaneous baking, for heating the layers at the same time, is carried out at a temperature such that the glass material forming the protrusion 70 melts and droops down so as to touch the substrate.

Figure 5F:
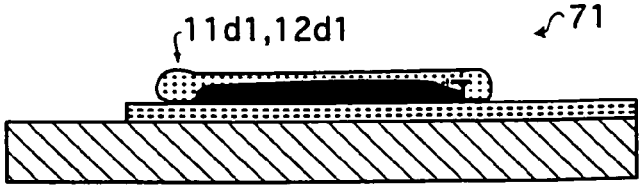

By performing the simultaneous baking, the resin component remained in the photosensitive metal electrode layers A51 and B56 is vaporized and glass frit becomes molten, and the width and thickness of the layer decrease. A metal electrode 71 (bus electrode) is thus formed. (FIG. 5F).

Specifically, it is preferable to bake the layers at a temperature higher than a melting point of the glass material by around 30–100° C., because when the temperature is higher than the melting point by less than 30° C., the rounded edge cannot be formed, and when the temperature is higher than the melting point by more than 100° C., the molten glass flows over the surface of the substrate and linearity of the electrodes decreases. While the temperature varies according to the glass material that is actually used, in a case in which lead-based material such as $PbO—B_2O_3—SiO_2$ based material is used as the glass material, it is preferable to bake at a temperature higher than the melting point by 40–60° C., and more preferably, at 593° C. of peak temperature, which is higher than the melting point by around 50° C.

The baking can be carried out in a batch type furnace. It is also possible to bake in a continuous belt furnace considering production effectiveness.

As have been described above, by baking at temperature such that the glass material contained in the protrusion 70 melts and droops down so as to touch the substrate, the molten protrusion 70 droops down by gravity. Accordingly, stress to the electrode to camber upward and causes edge-curl is released, in addition that the construction in which the first electrodes 11*b* covers the second electrodes 11*c* as have been described above is realized. As a result, surfaces of side edges of the bus electrode become smooth and rounded. Note that, in a case where a conventional manufacturing method is employed, the protrusion 70 cannot be formed even when the exposure is performed twice. This is because the same mask is used in the both exposing process, and accordingly the glass does not droop down to the substrate even when the glass is molten during baking.

Forming the electrodes having a laminated structure according to the above method, the process margin becomes larger because of the reasons stated below. Note that the "margin" in this context indicates all sorts of fluctuation factors in the process of manufacturing, and it is preferable to make such fluctuation factors as little as possible.

Generally speaking, in a case of the electrodes having a laminated structure, the crosslinking reaction proceeds sufficiently at the top surface the layer, but does not proceeds at the electrode forming plane as much as at the top surface. Accordingly, undercut in the developing becomes large, and especially at the thin line, the development margin becomes small.

On the other hand, in the present embodiment, because each layer is exposed separately, the crosslinking reaction proceeds further at the bottom surface of the layer in comparison with a case in which a thicker layer is exposed (because high-polymerization proceeds). Accordingly, dissolution of component of the layer due to the development is reduced. Therefore, undercut is drastically suppressed in comparison with the conventional method for manufacturing the electrodes.

In addition, it is possible to increase the exposure margin by suppressing the misalignment in exposing, because the lower layer is made thinner than the upper layer.

Accordingly, the process margin greatly improves by increasing both the development and exposure margin.

Moreover, because disconnection due to dust is suppressed in comparison with a case in which a pattern is formed by exposing one time, it is possible to form the electrodes having high reliability without disconnection.

The reason for this is that, because the exposure is performed in plural times separately, the possibility that dust attaches at a corresponding part to which dust is attached in earlier exposure is extremely low.

By the manufacturing process explained above, it is possible to provide the electrodes with high quality without defects such as disconnection, by using the manufacturing method having greater process margin in comparison with the conventional manufacturing method.

Note that the electrodes formation method according to the present invention does not restricted to the present Embodiment, and the followings may be also employed.

As the photosensitive pastes A and B, both same and different pastes can be used.

While the photosensitive pastes A and B contained $RuO_2$ and Ag in this Embodiment, another kind of paste can be used.

In order to apply the photosensitive pastes, a method other than the screen printing method can be used.

A number of layers formed can be more than two layers.

In order to dry after printing, a temperature profile other than the one such that the temperature goes up linearly from the room temperature to 90° C. and keeps the temperature at 90° C. for a certain period of time can be employed, and a furnace other than the IR furnace can be used.

While, in the present Embodiment, the width of the exposing mask A is 30 μm and the exposing mask B is 40 μm, the same effect can be obtained if the width of exposing mask A is smaller than the exposing mask B.

[Formation Method 2]

FIGS. 6A–6E are process drawings illustrating another formation method of the scanning electrodes 11 and the sustaining electrodes 12 according to the present Embodiment.

Figure 6A:
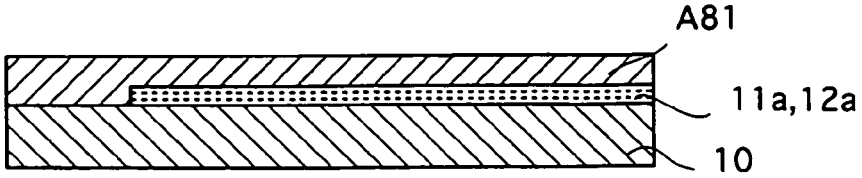
FIGS. 6A–6E are process drawings illustrating another formation method of the scanning electrodes and the sustaining electrodes.

First, a black negative photosensitive paste A, containing such as $RuO_2$ particles, is applied to the transparent electrodes 11*a* and 12*a* using a screen printing method. The negative photosensitive paste A is then dried in an IR furnace having a temperature profile such that the temperature goes up linearly from the room temperature to 90° C. and keeps the temperature at 90° C. for a certain period of time, and thus a photosensitive metal electrode layer A81 is obtained, which is the negative photosensitive paste A from which a solution and such are removed (FIG. 6A).

Figure 6B:
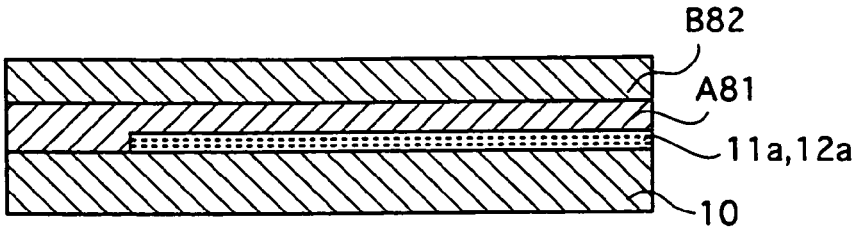

Next, a negative photosensitive paste B containing Ag particles is applied to the photosensitive metal electrode layer A51 by a screen printing method. By drying the paste so as to remove a solution and such from the negative photosensitive paste B in the IR furnace having the same temperature profile as stated above, a photosensitive metal electrode layer B82 is formed (FIG. 6B).

Figure 6C:
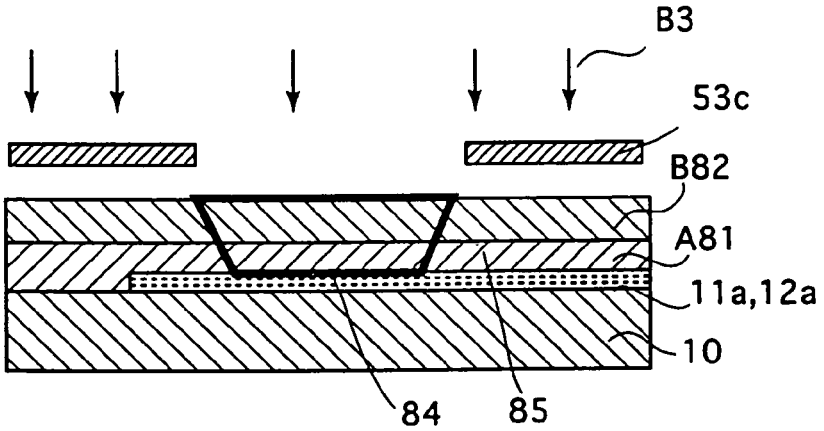

Further, both of the photosensitive metal electrode layers A81 and B82 are exposed by an ultraviolet ray 83 irradiated through an exposure mask 53C having a predetermined width (40 μm for example) under conditions such that the luminance is 10 $mW/cm^2$, the light exposure is 300 $mJ/cm^2$, and the distance between the mask and the substrate is 100 μm, for example. In exposure, a crosslinking reaction proceeds from a top surface of the photosensitive metal electrode layer A81, and the layer is high-polymerized, and thus an exposed part 84 (encircled with a bold line) and a non-exposed part 85 are formed (FIG. 6C). Note that, because the crosslinking reaction starts from the top surface of the photosensitive metal electrode layer A81, the reaction does not reach the bottom surface of the layer and the photosensitive metal electrode layer B82.

Figure 6D:
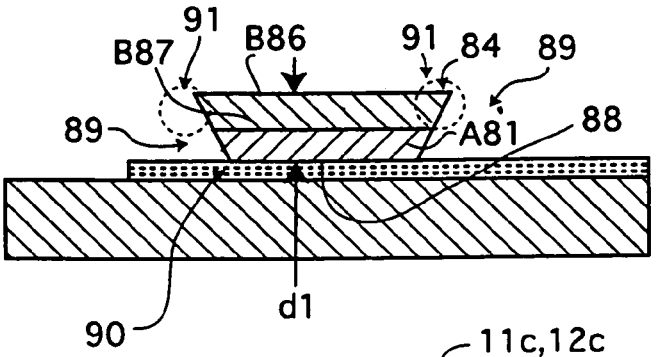

Next, development is performed using a developing solution. As the developing solution, an aqueous solution containing 0.4 wt % of sodium carbonate is commonly used. As shown in FIG. 6D, the non-exposed part 85 is removed and the patterned photosensitive metal electrode layers A81 and B82 are left. The amount of elution of component to form the layers caused by development are small at a top surface B86 of the exposed part 84 of the photosensitive metal electrode layer B82, while the amount of elution of component at bottom surface B87 and the photosensitive metal electrode layer A81 is large because the crosslinking reaction does not reach.

At the top surface B86 of the exposed part 84, dissolution by the developing solution does not proceed greatly, because the crosslinking reaction proceeds sufficiently, as have been explained, above in comparison with the bottom surface, while dissolution by the developing solution proceeds greatly at a bottom surface 88 of the layer. Accordingly, an undercut 89 is formed at the exposed part 84. The development is performed in consideration with the amount of undercut and contacting area between metal electrodes and the substrate. Specifically, it is desirable that conditions such as concentration of the development solution, time for the development, and temperature are set such that the amount of undercut becomes half to three times as large as a thickness d1 at the central part of the of the electrodes after development. The reason why the amount of undercut after the development should behalf or more of the thickness d1 at the central part of the electrode is to obtain a shape in which the second conductive layer covers the first conductive layer. The reason why the amount of undercut after the development should be three times or less of the thickness d1 at the central part of the electrode is that the metal electrodes are susceptible to separation when contacting part between the first conductive layer and the surface on which the electrode is formed becomes too small.

Consequently, as shown in FIG. 6D, a cross-section of the exposure part 84 forms a trapezoidal part 90 with an upper base being as long as the top surface of the photosensitive metal electrode layer A81 at the exposure part 84 in a widthwise direction, and a lower base being as long as the bottom surface of the photosensitive metal electrode layer A82 of the exposure part 84 in a widthwise direction. Thus, edges of the photosensitive metal electrode layer A82 projects from the photosensitive metal electrode layer A81 when viewed at a cross-section taken in a width wise direction. Such a projecting part is called a protrusion 91.

Next, a simultaneous baking is carried out at a temperature such that the glass material forming the protrusion 91 melts and droops down so as to touch the substrate.

Figure 6E:
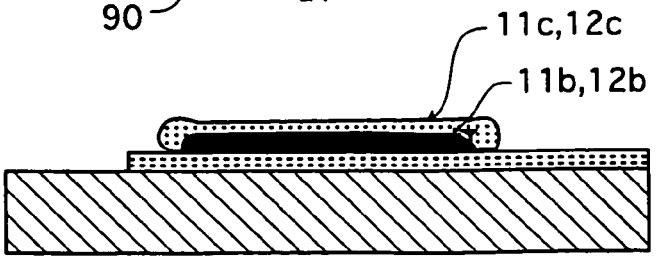

By performing the simultaneous baking in which all layers are baked at the same time, the resin component remained in the photosensitive metal electrode layers A81 and B82 are vaporized and the glass frit becomes molten, and the width and the thickness of the layer decrease. A metal electrode (bus electrode) is thus formed (FIG. 6E).

Specifically, it is preferable to bake at a temperature higher than a melting point of the glass material by 30–100° C., because when the temperature is higher than the melting point by 30° C. or lower, the rounded edge cannot be formed, and when the temperature is higher than the melting point by 100° C. or higher, the molten glass flows over the surface of the substrate and linearity of the electrodes decreases. While such temperature varies according to the glass material that is actually used, in a case in which lead-based material such as $PbO—B_2O_3—SiO_2$ based material is used as the glass material, it is preferable to bake at a temperature higher than the melting point by 40–60° C., more preferably, at 593° C. of peak temperature, which is higher than the melting point by round 50° C.

By performing the baking as described above, the protrusion 91 melts and droops down so as to touch the substrate by gravity. Accordingly, stress to the electrode to camber upward and causes edge-curl is released, in addition that the construction in which the first electrodes cover the second electrodes as described above is realized. As a result, the surface of the side edges of the bus electrode becomes smooth and rounded. Such effect obtained here is the same as the above Formation Method 1.

[Data Electrodes]

FIGS. 7A–7D are process drawings illustrating a formation method of the data electrodes.

Figure 7A:
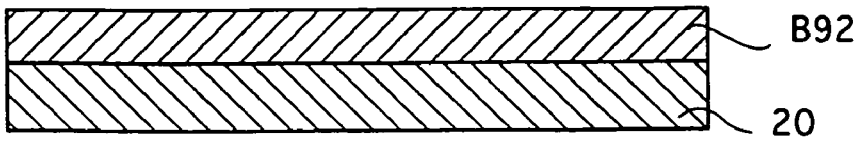
FIGS. 7A–7D are process drawings illustrating a formation method of the data electrodes.

A negative photosensitive paste B containing Ag particles is applied to the glass substrate by a screen printing method. By drying the paste so as to remove a solution and such from the negative photosensitive paste B in the IR furnace having the same temperature profile as stated above, a photosensitive metal electrode layer B92 is formed (FIG. 7A).

Figure 7B:
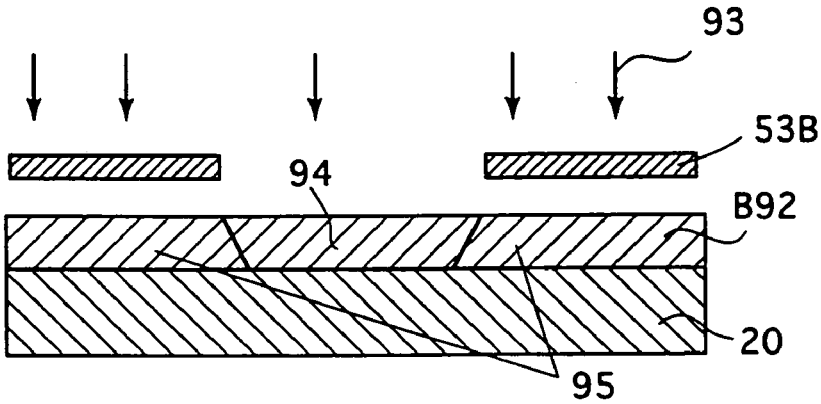

Next, the photosensitive metal electrode layer B92 is exposed by an ultraviolet ray 93 irradiated through an exposure mask 53D having a predetermined width (40 μm for example) under conditions such that the luminance is 10 $mW/cm^2$, the light exposure is 200 $mJ/cm^2$, and the distance between the mask and the substrate is 100 μm, for example. In exposure, a crosslinking reaction proceeds from a top surface of the photosensitive metal electrode layer B92, and the layer becomes high-polymerized, and thus an exposed part 94 and a non-exposed part 95 are formed (FIG. 7B). Note that, because the crosslinking reaction starts from the top surface of the photosensitive metal electrode layer A81, the reaction does not reach the bottom surface of the layer.

Figure 7C:
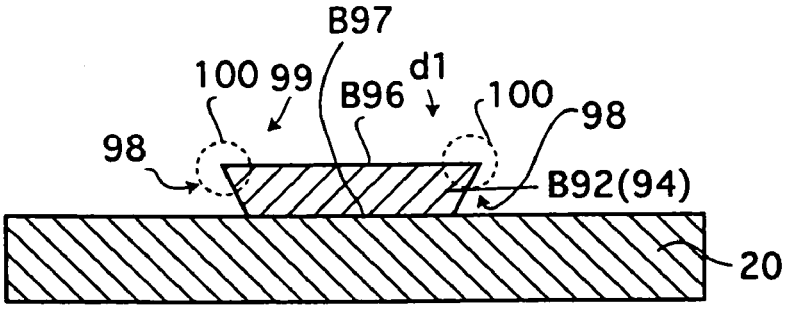

Then, development is performed using a developing solution. As the developing solution, an aqueous solution containing 0.4 wt % of sodium carbonate is commonly used. As shown in FIG. 7C, the non-exposed part 95 is removed and the patterned photosensitive metal electrode layer B92 remains (FIG. 7C). The amount of elution of component for forming the layers caused by development are small at the top surface of the exposed part 94 of the photosensitive metal electrode layer B92, while the amount of elution of component at the bottom surface is large because the crosslinking reaction does not reach.

At the top surface B96 of the exposed part 94, dissolution by the developing solution does not proceed greatly, because the crosslinking reaction proceeds sufficiently as have been explained above in comparison with the bottom surface, while dissolution by the developing solution proceeds greatly at a bottom surface B97 of the layer. Accordingly, an undercut 98 is formed at the exposed part 94. The development is performed in consideration with the amount of undercut and contacting area between metal electrodes and the substrate. Specifically, it is desirable that conditions such as concentration of the development solution, time for the development, and temperature are set such that the amount of undercut becomes half to three times as large as a thickness d1 at the central part of the of the electrodes after development. The reason why the amount of undercut after the development should be half or more of the thickness d1 at the central part of the electrode is to obtain a rounded edge at the sides of the electrodes. The reason why the amount of undercut after the development should be three times or less of the thickness d1 at the central part of the electrode is that the metal electrodes are susceptible to separation when contacting part between the electrodes and the substrate is too small.

Consequently, as shown in FIG. 7C, a cross-section of the exposure part 94 forms a trapezoidal part 99 with an upper base being as long as the top surface of the photosensitive metal electrode layer B92 in a widthwise direction, and a lower base being as long as the bottom surface of the photosensitive metal electrode layer B92 in a widthwise direction. Thus, edges of the photosensitive metal electrode layer B92 project from the photosensitive metal electrode layer A81 when viewed at a cross-section taken in a widthwise direction. Such a projecting part is called a protrusion 100.

Next, a simultaneous baking in which all layers are baked at the same time is carried out at a temperature such that the glass material forming the protrusion 100 melts so as to touch the substrate by the effect of gravity.

Figure 7D:
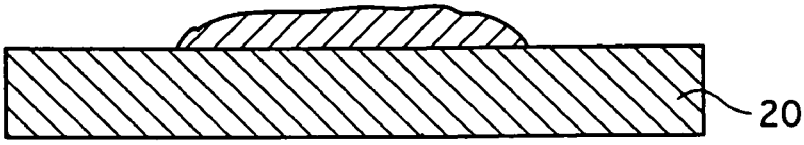

By performing the simultaneous baking, the resin component remained in the photosensitive metal electrode layer B92 is vaporized and the glass frit becomes molten, and the width and the thickness of the layer decrease. A metal electrode (data electrode) is thus formed (FIG. 7D).

Specifically, it is preferable to bake at a temperature higher than a melting point of the glass material by 30–100° C., because when the temperature is higher than the melting point by 30° C. or lower, the rounded edge cannot be formed, and when the temperature is higher than the melting point by 100° C. or higher, the molten glass flows over the surface of the substrate and linearity of the electrodes decreases. While the temperature varies according to the glass material that is actually used, in a case in which lead-based material such as $PbO—B_2O_3—SiO_2$ based material is used as the glass material, it is preferable to bake at a temperature higher than the melting point by around 40–60° C., more preferably, at 593° C. of peak temperature, which is higher than the melting point by around 50° C.

By performing the baking as described above at the temperature such that the glass material forming the protrusion becomes soft, the protrusion 100 melts and droops down so as to touch the substrate by gravity. Accordingly, stress to the electrode to camber upward and cause edge-curl is released, and the side edges of the data electrodes becomes smooth and rounded. Such effect obtained here is the same as the above Formation Method 1.

[Variation of Shape of Bus Electrodes]

In order to make the side edges 11*d*1 and 12*d*1 rounded, it is effective to combine the above methods with a method stated below.

Because the second conductive layer is formed according to the first conductive layer, the side edges of the bus electrodes can be effectively made smooth and rounded, when the side edges of the first conductive layer is made appropriate to be rounded edges (a method for controlling the thickness below).

Figure 8A:
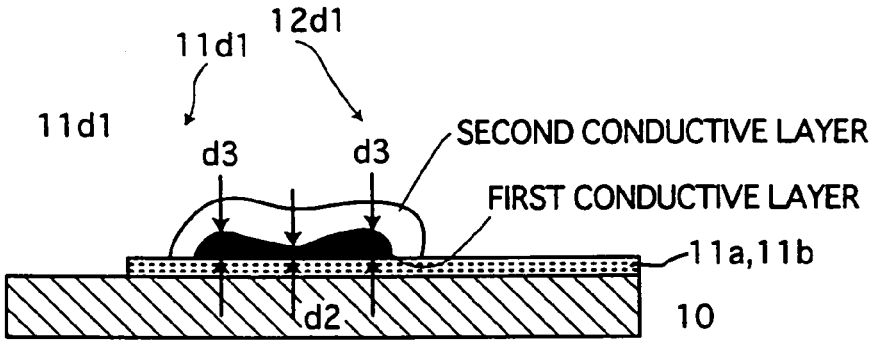
FIGS. 8A and 8B are process drawings illustrating yet another formation method of the scanning electrodes and the sustaining electrodes.

Specifically, by applying the photosensitive paste to be the first conductive layer so that a thickness d2 at the central part in FIG. 8A becomes smaller than the thickness d3 at the both side in a widthwise direction, it is possible to obtain a smooth and rounded shape at the side edges 11*d*1 and 12*d*1. In order to make the thickness d2 at the central part smaller than the thickness d3 at the both side in a widthwise direction as shown in FIG. 8A, by applying the photosensitive paste to be the first conductive layer selectively at the side edges of the first conductive layer using a screen printing method, it is possible to selectively make the said part thicker.

Figure 8B:
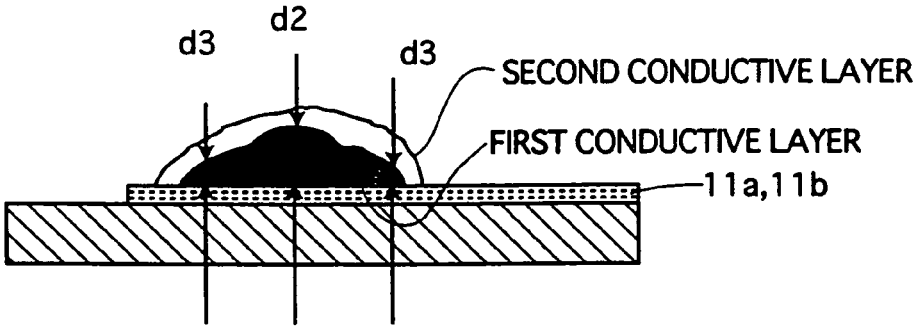

Moreover, by applying the photosensitive paste to be the first conductive layer so that a thickness d2 at the central part in FIG. 8B becomes larger than the thickness d3 at the both side in a widthwise direction, it is possible to obtain a smooth and rounded shape at the side edges 11*d*1 and 12*d*1. In order to make the thickness d2 at the central part larger than the thickness d3 at the both side in a widthwise direction as shown in FIG. 8B, it is possible to selectively make the said part thicker by applying the photosensitive paste to be the first conductive layer selectively at the central part of the first conductive layer using a screen printing method.

Second Embodiment

In the first embodiment, the widths of the exposure masks are set so that 53A (W1) becomes smaller than 53B (W2). According to the second embodiment, it is also possible to obtain the same effect in a case in which the upper layer is exposed using the same exposure mask used in the exposure of the upper layer, or using a exposure mask having the same width as the mask used in the exposure of the upper layer. Specifically, conditions are set as shown in the table 1, where at least one of the luminance, the light exposure, and the proxy amount (the distance between the mask and the substrate) is smaller than the conditions for the upper layer exposure. The rest of the process is conducted in the same manner as the first embodiment.

TABLE 1

| | Examples of Exposure | | | |
|---|---|---|---|---|
| | Luminance ($mW/cm^2$) | Light Exposure ($mJ/cm^2$) | Proxy Amount (μm) | Width after Development (μm) |
| Comparison Example | 1 | 1 | 1 | 1 |
| Example 1 | 0.5 | 1 | 1 | 0.9 |
| Example 2 | 1 | 0.17 | 1 | 0.9 |
| Example 3 | 1 | 1 | 0.5 | 0.9 |
| Example 4 | 0.5 | 0.17 | 1 | 0.81 |
| Example 5 | 0.5 | 1 | 0.5 | 0.81 |
| Example 6 | 1 | 0.17 | 0.5 | 0.81 |
| Example 7 | 0.5 | 0.17 | 0.5 | 0.72 |

As in Example 1 in the table 1, by setting the luminance small, it is possible to suppress the width getting larger due to halation and such. Accordingly, it is possible to make the width small even when the same mask or a mask with the same width as in the exposure of the lower layer is used.

Further, by setting the light exposure small, as in Example 2 in the table 1, the crosslinking reaction does not proceeds sufficiently and the electrode forming component is eluted into the developing solution in developing. Accordingly, it is possible to make the width small even when the same mask or a mask with the same width as in the exposure of the lower layer is used.

In addition, by setting the proxy amount small, as in Example 3 in the table 1, it is possible to keep the width from getting larger due to halation and such. Accordingly, it is possible to make the width small even when the same mask or a mask with the same width as in the exposure of the lower layer is used.

Moreover, by combining two or three of the above conditions of the luminance, the light exposure, and the proxy amount, it is possible to obtain synergy effect to make the width thinner.

In the present embodiment, values shown in the table 1 are mere examples, and relative values for conditions are not limited to the values in the table 1, if the relation between values meets the above stated conditions.

Third Embodiment

By a method for manufacturing the electrodes according to the third embodiment, like the first and second embodiments, it is possible to improve the production margin and to manufacture the electrodes having high reliability without disconnection by making the width of the lower layer smaller than the width of the upper layer. Specifically, the lower layer is exposed using an exposure mask, having smaller width than a mask used in the upper layer exposure, or the same exposure mask used in the exposure of the upper layer or a exposure mask having the same width as the mask used in the exposure of the upper layer under the similar conditions stated in the table 1, for example.

Figure 9:
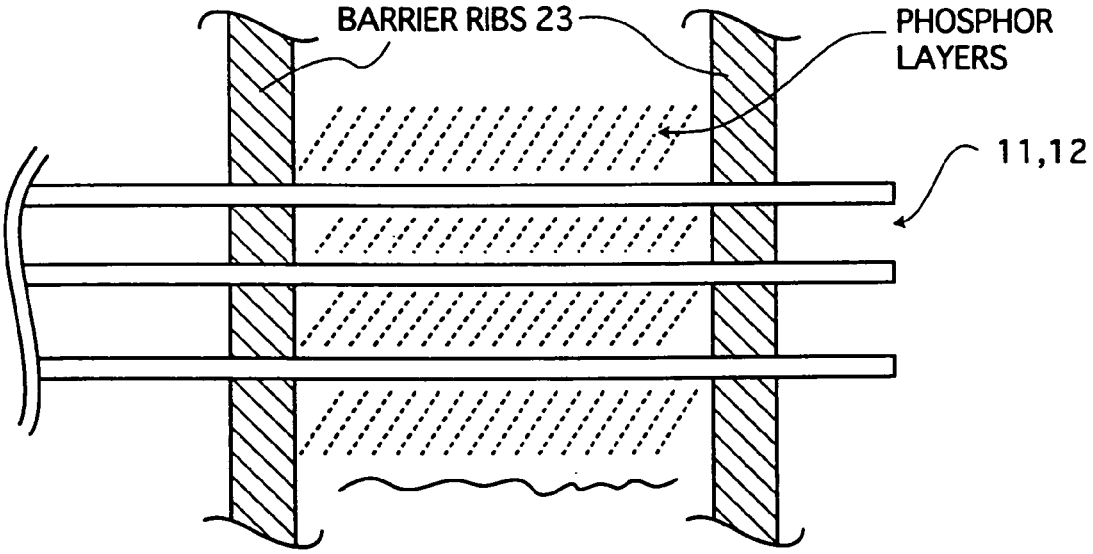
FIG. 9 is a plane view illustrating a construction of fence electrodes according to the Third Embodiment.

In the present embodiment, an example in which electrodes are formed into a shape having parts connecting two adjacent electrodes (hereinafter referred to as a short-bar) is explained. In a case in which fence electrodes made of a plurality of thin wires are used for the sustaining electrodes and the scanning electrodes as shown in FIG. 9, the short-bars are generally formed for connecting thin wires in order to prevent disconnection therebetween. In a case in which each thin wire has a bilayer structure as the bus electrodes stated above, short-bars can be formed only at the upper layer or at both upper and lower layers.

FIGS. 10A–10D are process drawings illustrating a formation method of the fence electrodes.

Figure 10A:
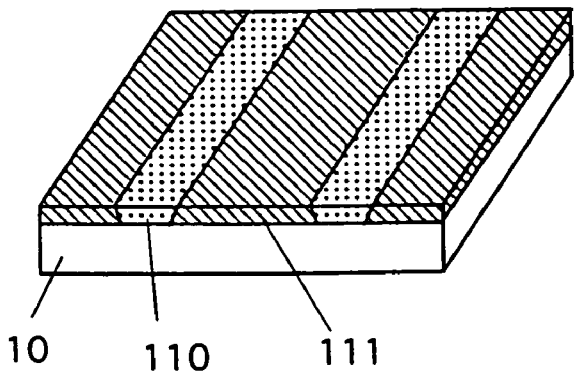
FIGS. 10A–10D are process drawings illustrating a formation method of the fence electrodes.
Figure 10B:
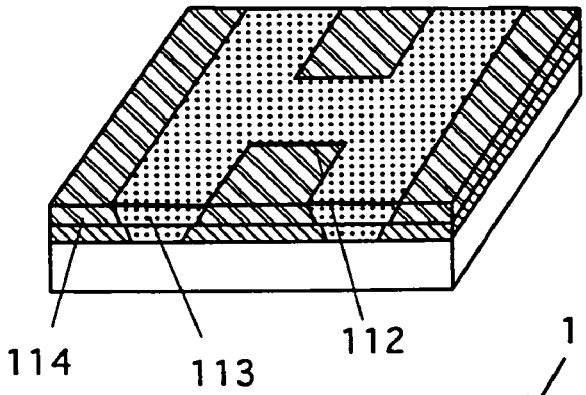

In the lower layer exposure according to the first and second embodiments, the exposure is performed using an exposure mask without a short-bar pattern. An exposure part 110 and a non-exposure part 111 having the same electrode pattern as in the first and second embodiments are formed (FIG. 10A). Next, in the upper layer exposure, the exposure is performed using an exposure mask having a short-bar pattern of the same width as the electrode, and an exposure part 113 having short-bars 112 and a non-exposure part 114 are formed (FIG. 10B).

Figure 10C:
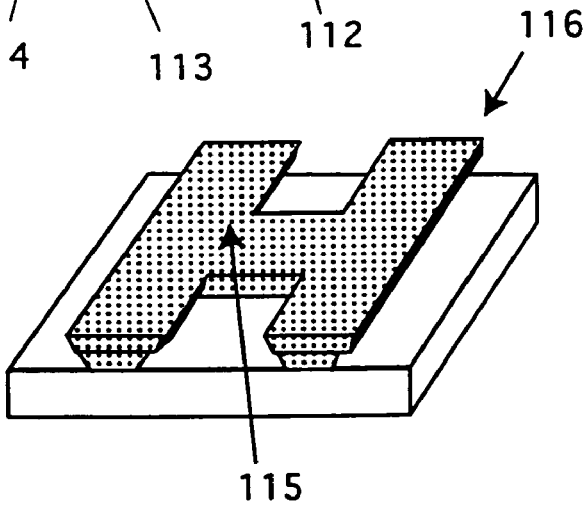

Then, an electrode pattern 116 having short-bars 115 is formed by performing development (FIG. 10C). Note that, because short-bars are only exposed at the upper layer and not at the lower layer, a shift in alignment in the exposure can be suppressed and it is possible to improve the exposure margin in the manufacturing process.

Figure 10D:
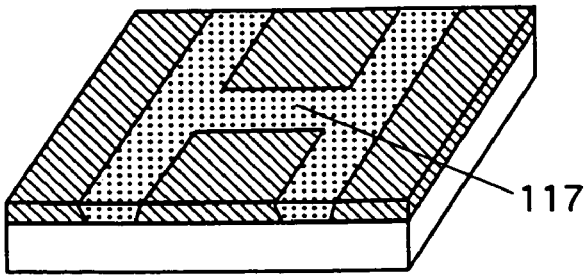

Further, in the exposure of the lower layer, it is also possible to use an exposure mask having a short-bar pattern and form an electrode pattern having short-bar 117 (FIG. 10D). In this case, it is desirable that the short-bar pattern is not formed at the upper layer in order to obtain better production margin as in the above, although black electrode material is not covered by white electrodes having lower resistance and the resistance at the short-bar increases.

Note that a width of the short-bar can be other than the same width as the electrodes, and is not limited to the present embodiment.

Fourth Embodiment

FIGS. 11A–11E are schematic view, corresponding to FIGS. 5A–5F while not illustrating the transparent electrodes, illustrating constructions of the main part and a formation method of the electrodes according to the

Fourth Embodiment

First, a black negative photosensitive paste A, containing such as ruthenium oxide particles, resin material PMMA (polymethyl methacrylate), polyacrylic acid, and such, and glass having low softening point, is printed on a glass substrate 10 by a screen printing method.

Then, the negative photosensitive paste A is dried. A temperature profile of this IR furnace is set such that the temperature goes up linearly from the room temperature to 90° C. and keeps the temperature at 90° C. for a certain period of time.

Figure 11A:
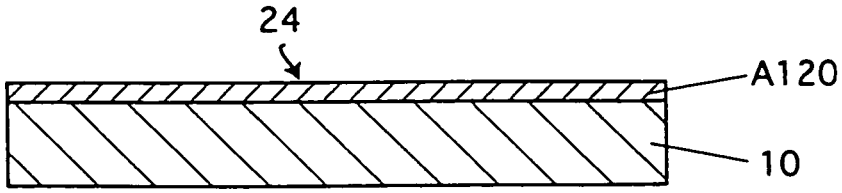
FIGS. 11A–11E are process drawings illustrating a formation method of the scanning electrodes and the sustaining electrodes according to the Fourth Embodiment.

A photosensitive metal electrode layer A120 is formed by removing a solution in the black photosensitive paste (FIG. 11A).

The photosensitive metal electrode layer A120 here is 4 μm in thickness, for example.

Figure 11B:
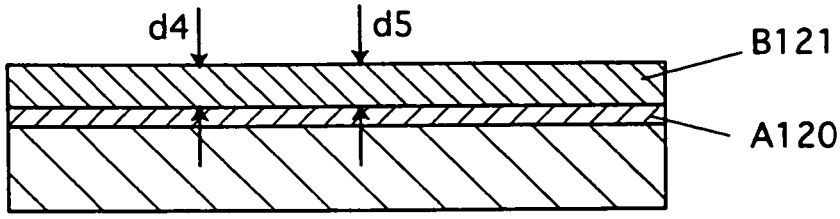

Next, a black negative photosensitive paste B, containing such as ruthenium oxide particles, resin material such as PMMA (polymethyl methacrylate), polyacrylic acid, and such, and glass having low softening point, is printed on the photosensitive metal electrode layer A120 using a polyester screen plate having a predetermined mesh (such as 380 mesh for example). Then the negative photosensitive paste B is dried in an IR furnace having the same temperature profile as stated above, and a photosensitive metal electrode layer B121 is formed by removing a solution in the photosensitive paste B (FIG. 11B).

Thickness d5 of the photosensitive metal electrode layer B121 here is thicker than a thickness d4 of photosensitive metal electrode layer A120, and is 6 μm, for example.

Figure 11C:
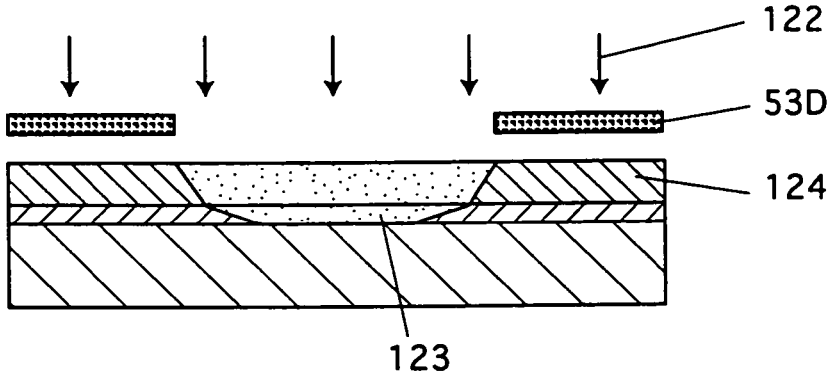

Further, the photosensitive metal electrode layer B121 is exposed by an ultraviolet ray 122 irradiated through an exposure mask 53D having a predetermined width (40 μm for example) under predetermined conditions (for example, the luminance is 10 mW/cm$^2$ the light exposure is 300 mJ/cm$^2$, and the distance between the mask and the substrate is 100 μm). In exposure, a crosslinking reaction proceeds from a top surface of the photosensitive metal electrode layer B121, and the layer is high-polymerized, and thus an exposed part 123 and a non-exposed part 124 are formed (FIG. 11C).

Next, development is performed using a developing solution containing 0.4 wt % of sodium carbonate.

Figure 11D:
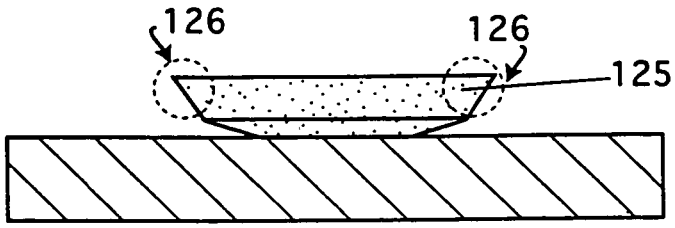

As have been explained in the first embodiment, the development is performed considering conditions such as concentration of the development solution, time for the development, and temperature, so that a cross-section of the exposure part 123 forms a trapezoidal part 125 with an upper base being as long as the top surface of the photosensitive metal electrode layer B121 in a widthwise direction, and a lower base being as long as a bottom surface of the photosensitive metal electrode layer B121 in a widthwise direction (FIG. 11D).

Then, a simultaneous baking in which all layers are baked at the same time is carried out at a temperature such that the glass material forming the protrusion 126 becomes soft.

Figure 11E:
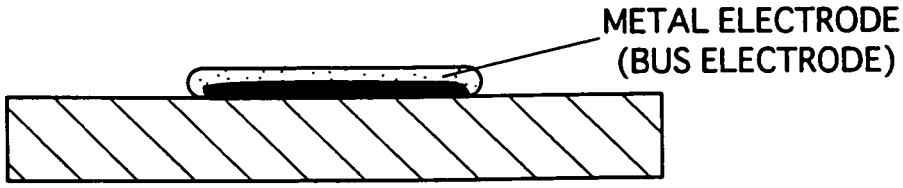
Figure 12:
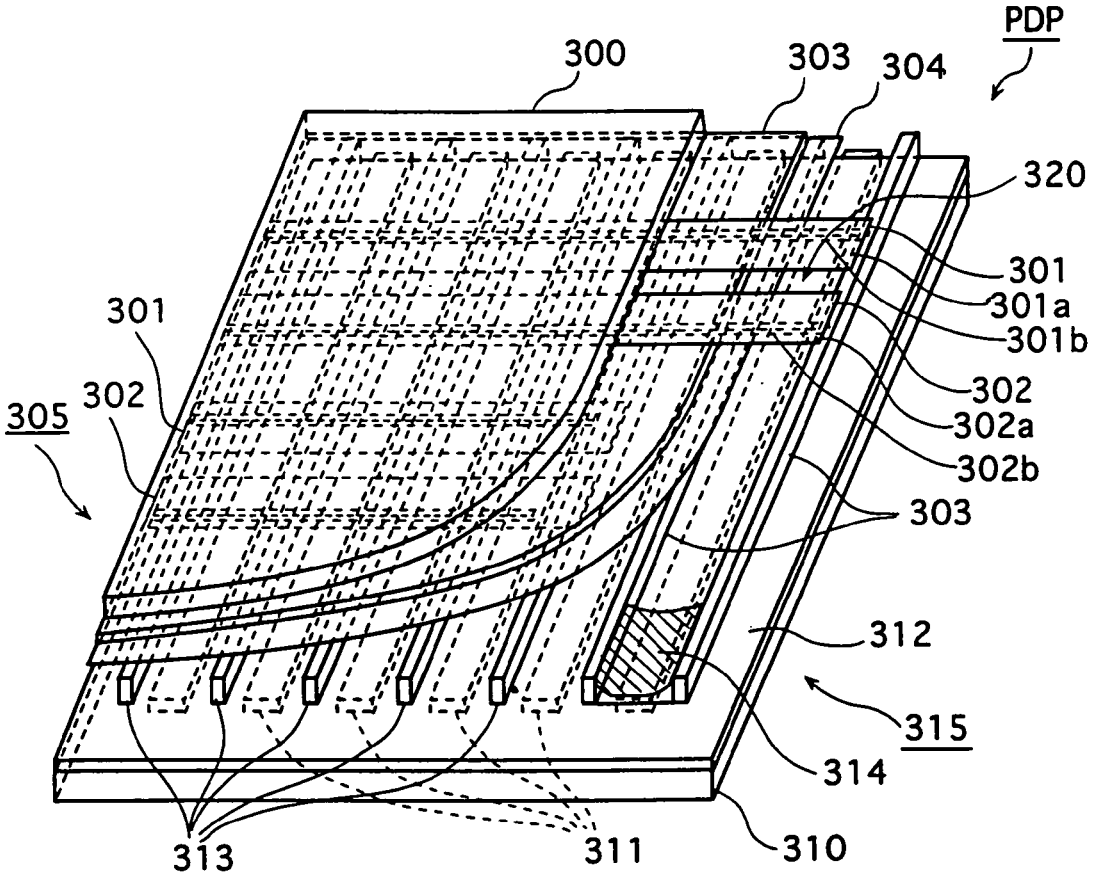
FIG.12 PRIOR ART
FIG. 12 is a perspective view illustrating a construction of a panel member of a conventional plasma display panel.

By performing the baking, the resin component remained in the photosensitive metal electrode layers A120 and B121 are burnt. Also, glass having a low softening point contained in the photosensitive metal electrode layers A120 and B121 melts and then solidifies. Accordingly, the width and thickness of the layer decrease, and metal electrodes are thus formed (FIG. 11E).

Generally speaking, in baking a lamination of an upper layer containing glass having a low softening point and a lower layer containing resin, if glass having a low softening point in the upper layer melts quickly, formed metal electrodes are susceptible to blisters because gas generated as the resin in the lower layer is burnt is enclosed in the layer. The blisters are parts formed in the electrodes, in which gas generated when baking material of the electrode is left.

On the contrary, in the present embodiment, because the photosensitive metal electrode layer A120 is made thinner than the photo sensitive metal electrode layer B121, the resin component in the photosensitive metal electrode layer B121 is burnt substantially completely before the glass having a low softening point solidifies. Thus, the blisters are suppressed.

Table 2 shows status of the blisters when the thickness of the photosensitive metal electrode layers A120 and B121 are 4 μm and 6 μm. Note that, in the table 2, ○ indicates no blister is generated, Δ indicates blisters are generated slightly, and X indicates blisters are generated.

TABLE 2

State of Blisters according to Difference in Thickness after Development

| Thickness of Electrode A | Thickness of Electrode B | State of Blisters | Thickness B/ Thickness A |
|---|---|---|---|
| 6 μm | 6 μm | X | 1.0 |
| 6 μm | 4 μm | X | 0.67 |
| 4 μm | 6 μm | ○ | 1.2 |
| 4 μm | 4 μm | X | 1.0 |
| 4.8 μm | 5.2 μm | ○ | 1.08 |
| 5.2 μm | 6 μm | Δ | 1.15 |
| 4 μm | 4.8 μm | Δ | 1.2 |

In a case in which an electrode layer A (the lower layer) is thicker than an electrode layer B (the upper layer), heat capacity becomes smaller because volume of the glass having a low softening point and such contained in the electrode layer B is small. Accordingly, the glass having a low softening point starts melting before the resin component in the electrode layer A completely vaporizes, and vaporized component is enclosed at a boundary between the electrode layers A and B. Accordingly, the blisters are generated.

More specifically, in a case in which a laminated metal layer is formed using materials such as resin and glass having a low softening point, in the baking step, gas, which is made of the resin and moisture and to be released into air through the upper layer, cannot pass through the upper layer if the upper layer starts solidifying while hydroxyl group absorbed in the resin or the glass of the lower layer is burn-out. As result, the gas is enclosed within the electrodes and the blisters are formed on the electrodes.

It is also considered that the blisters are also generated in a case in which the electrode layer A is as thick as the electrode layer B, because the glass having a low softening point starts melting before vaporized component such as resin is completely released in air. However, in a case in which the electrode layer A is thinner than the electrode layer B, the having a low softening point starts melting after the vaporized component such as resin is sufficiently released in air, and therefore no blister is generated. In addition, even in a case in which the electrode layer A is thinner than the electrode layer B, if the electrode layer A is thicker than 5 μm, the blisters are slightly generated because large amount of resin which causes the blisters is contained. If the electrode layer B is thinner than 5 μm, the blisters are slightly generated because the glass having a low softening point starts melting quickly. Therefore, the blisters can be suppressed and hence it is most desirable when the electrode layer A is thinner than the electrode layer B, the electrode layer A is thicker than 5 μm, and the electrode layer B is thinner than 5 μm.

The blisters are also generated if a number of mesh on a printing screen plate used for the electrode layer A is the same as or smaller than a plate used for the electrode layer B, because the electrode layer A becomes the same as or thicker than the electrode layer B after printing. If the number of mesh on a printing screen plate used for the electrode layer A is larger than the electrode layer B, however, the blisters are not generated because the electrode layer A becomes thinner than the electrode layer B after printing. In addition, even if the number of mesh on a printing screen plate used for the electrode layer A is the same as or smaller than the electrode layer B, the blisters are not generated if the screen plate performed calendar treatment is used, because thickness is thin and it is possible to make the electrode layer A thinner than the electrode layer B.

Note that, while the photosensitive pastes A and B contain ruthenium oxide and Ag in the present embodiment, other material can be also used.

The resin component in the photosensitive pastes A and B do not have to contain PMMA and polyacrylic acid.

The photosensitive pastes A and B do not have to contain the glass having a low softening point.

The photosensitive pastes A and B do not have to be a negative type.

The substrate on which the electrode layers are formed does not have to be a glass substrate, and is not limited to the present embodiment. It is also possible that transparent electrodes and such are formed on the substrate made of such as glass in advance.

The method for applying the photosensitive pastes can be other than the screen printing method.

A number of layers formed is not restricted to two layers.

The conditions of drying after printing are not restricted to the temperature profile in which the temperature goes up linearly from the room temperature to 90° C. and keeps the temperature at 90° C. for a certain period of time, or to the IR furnace.

The thickness of the photosensitive pastes A and B can be other than 4 μm and 6 μm respectively if the photosensitive paste A is thinner than the photosensitive paste B, and preferably, B/A>=1.2, or the photosensitive paste A is thinner than 5 μm and the photosensitive paste B is thicker than 5 μm.

The conditions for the exposure can be other than the luminance is 10 mW/cm$^2$, the light exposure is 300 mJ/cm$^2$, and the distance between the mask and the substrate is 100 μm.

The developing solution does not have to contain 0.4 wt % of sodium carbonate.

The temperature in the baking after the development is not restricted to the peak temperature 540° C.

The values of thickness in the table 2 are not restricted to 4 μm, 4.8 μm, 5.2 μm, and 6 μm.

In addition, although it was confirmed that aluminum, silver and copper are most effective as the component of the electrode layers A and B in the present embodiment, it is possible to obtain the same effect using other kind of metal if the relation in thickness is the same.

Moreover, as a method for applying a paste in each embodiment, a method in which photosensitive layers are formed can also be used, in addition to a method in which photosensitive pastes are printed. In this case, it is possible to obtain the same effect by satisfying the relation in thickness as stated above.

INDUSTRIAL APPLICABILITY

The present invention, in which side edges of a bus electrode and data electrodes are formed in a rounded shape that suppresses the electric concentration, can be applied to a high quality plasma display device.

The invention claimed is:

1. A method for manufacturing a plasma display device having an electrode formation process in which a plurality of electrodes are formed on a substrate in a manner that a layer of material is patterned mainly by a photolithography method and then baked, wherein, in the electrode formation process, the electrodes having at least two layers are formed by a photolithography method using a paste containing photosensitive material, conductive material, and glass material, the electrode formation process comprising:

at least two coating steps;

a simultaneous exposing step in which the layers are exposed at the same time;

a simultaneous developing step in which the layers are developed at the same time; and a simultaneous baking step in which the layers are baked at the same time, and wherein the first layer is thinner than the second layer during a time after the developing has been done and before the baking is performed.

2. A method for manufacturing a plasma display device according to claim 1, wherein the plurality of electrodes are fence electrodes having a short-bar pattern on the second layer.

3. A method for manufacturing a plasma display device according to claim 1, wherein, in the simultaneous baking step, the glass material is baked at a temperature higher than a softening point of the glass material by 30° C. to 100° C.

4. A method for manufacturing a plasma display device according to claim 1, wherein the second layer contains Ag.

5. A method for manufacturing a plasma display device according to claim 1, wherein the first layer is made of black material.

6. A method for manufacturing a plasma display device according to claim 1, wherein the first layer contains ruthenium oxide.

7. A method for manufacturing a plasma display device having an electrode formation process in which a plurality of electrodes are formed on a substrate in a manner that a layer of material is patterned mainly by a photolithography method and then baked, wherein, in the electrode formation process, the electrodes having at least two layers are formed by a photolithography method using a paste containing photosensitive material, conductive material, and glass material, the two layers being a first layer and a second layer laminated in a stated order on the substrate, the electrode formation process comprising:

at least two coating steps;

at least two exposing steps;

a simultaneous developing step in which the layers are developed at the same time;

and a simultaneous baking step in which the layers are baked at the same time, and wherein the first layer is thinner than the second layer during a time after the developing has been done and before the baking is performed.

8. A method for manufacturing a plasma display device according to claim 7, wherein the plurality of electrodes are fence electrodes having a short-bar pattern on the second layer.

9. A method for manufacturing a plasma display device according to claim 7, wherein, in the simultaneous baking step, the glass material is baked at a temperature higher than a softening point of the glass material by 30° C. to 100° C.

10. A method for manufacturing a plasma display device according to claim 7, wherein the second layer contains Ag.

11. A method for manufacturing a plasma display device according to claim 7, wherein the first layer is made of black material.

12. A method for manufacturing a plasma display device according to claim 7, wherein the first layer contains ruthenium oxide.

* * * * *